US010005602B2

(12) United States Patent
Van Der Molen

(10) Patent No.: US 10,005,602 B2
(45) Date of Patent: Jun. 26, 2018

(54) COLLAPSIBLE POUCH PROVIDED WITH A CLOSURE ASSEMBLY

(71) Applicant: IPN IP B.V., Houten (NL)

(72) Inventor: Peter Jan Van Der Molen, Den Haag (NL)

(73) Assignee: Scholle IPN IP BV (NL)

( * ) Notice: Subject to any disclaimer, the term of this patent is extended or adjusted under 35 U.S.C. 154(b) by 197 days.

(21) Appl. No.: 14/896,594

(22) PCT Filed: Jun. 5, 2014

(86) PCT No.: PCT/NL2014/050358
§ 371 (c)(1),
(2) Date: Dec. 7, 2015

(87) PCT Pub. No.: WO2014/196859
PCT Pub. Date: Dec. 11, 2014

(65) Prior Publication Data

US 2016/0145025 A1 May 26, 2016

(30) Foreign Application Priority Data

Jun. 7, 2013 (NL) ..... 2010938
May 1, 2014 (NL) ..... 2012736

(51) Int. Cl.
*B65D 75/58* (2006.01)
*B65D 47/10* (2006.01)
(Continued)

(52) U.S. Cl.
CPC ..... *B65D 75/5883* (2013.01); *B65B 1/02* (2013.01); *B65B 3/022* (2013.01); *B65B 7/02* (2013.01);
(Continued)

(58) Field of Classification Search
CPC ..... B65D 75/5883; B65D 47/10; B65D 2575/586; B65D 41/0421; B65D 2575/583; B65B 3/022; B65B 1/02; B65B 7/02
(Continued)

(56) References Cited

U.S. PATENT DOCUMENTS 5,911,340 A * 6/1999 Uematsu ..... B29C 45/006 215/250
2006/0201967 A1* 9/2006 Romer ..... B65D 51/225 222/92
(Continued)

FOREIGN PATENT DOCUMENTS

EP 0763482 A1 3/1997
EP 0936156 A2 8/1999
(Continued)

*Primary Examiner* — Nicholas J Weiss
*Assistant Examiner* — Robert Nichols, II
(74) *Attorney, Agent, or Firm* — The Watson IP Group, PLC; Jovan N. Jovanovic; Vladan M. Vasiljevic

(57) ABSTRACT

A collapsible pouch (1) is provided with a closure assembly (10; 110; 210; 310; 410), which comprises a monolithic spout base and cap part (11; 111; 311) and a tubular inner part (30; 130; 230; 330; 430). The inner part comprises a fixation portion (31; 131; 331; 431) and a neck portion (32; 132; 232) and has been inserted into the spout base and cap part via the lower opening of the bore thereof in a pre-assembly operation prior to sealing of the pre-assembled closure assembly between the two walls (3, 4) of the pouch. The fixation portion is received and fixed in the bore of the spout base (12; 112; 212). The neck portion protrudes from the spout base into the cap cavity and extends to a mouth opening (34; 134) of the neck portion. The neck portion is provided with at least one circumferential sealing surface (32*a;* 32*b;* 32*c;* 132*a;* 132*b*) and the cap has at the interior side thereof at least one circumferential sealing surface
(Continued)

(23*a;* 22*b;* 22*c;* 123*a*) that sealingly engages said at least one circumferential sealing surface of the neck portion.

18 Claims, 16 Drawing Sheets

(51) Int. Cl.
*B65B 1/02* (2006.01)
*B65B 3/02* (2006.01)
*B65B 7/02* (2006.01)
*B65D 41/04* (2006.01)

(52) U.S. Cl.
CPC ..... *B65D 47/10* (2013.01); *B65D 41/0421* (2013.01); *B65D 2575/586* (2013.01)

(58) Field of Classification Search
USPC ..... 222/153.06, 107, 92; 383/5
See application file for complete search history.

(56) References Cited

U.S. PATENT DOCUMENTS

| | | | | |
|---|---|---|---|---|
| 2007/0205202 | A1* | 9/2007 | Hildebrand ..... | B65D 75/5883 220/613 |
| 2008/0199108 | A1* | 8/2008 | Rogers ..... | B65D 47/10 383/38 |
| 2011/0210122 | A1* | 9/2011 | Benoit-Gonin .... | B65D 41/3447 220/277 |

FOREIGN PATENT DOCUMENTS

| | | | |
|---|---|---|---|
| EP | 2597051 | A1 | 5/2013 |
| JP | H08133308 | A | 5/1996 |
| NL | 1013647 | C2 | 11/1999 |
| WO | 9845190 | A1 | 10/1998 |
| WO | 0003921 | A2 | 1/2000 |
| WO | 20072292 | A2 | 1/2007 |

* cited by examiner

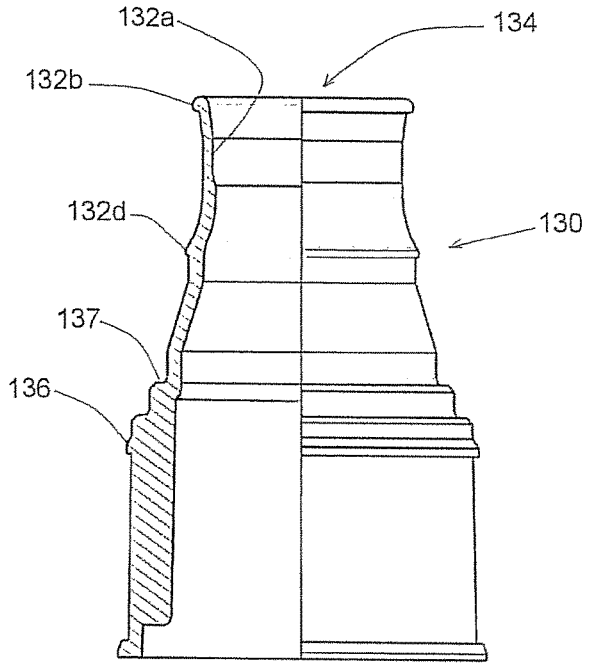
Fig 9a
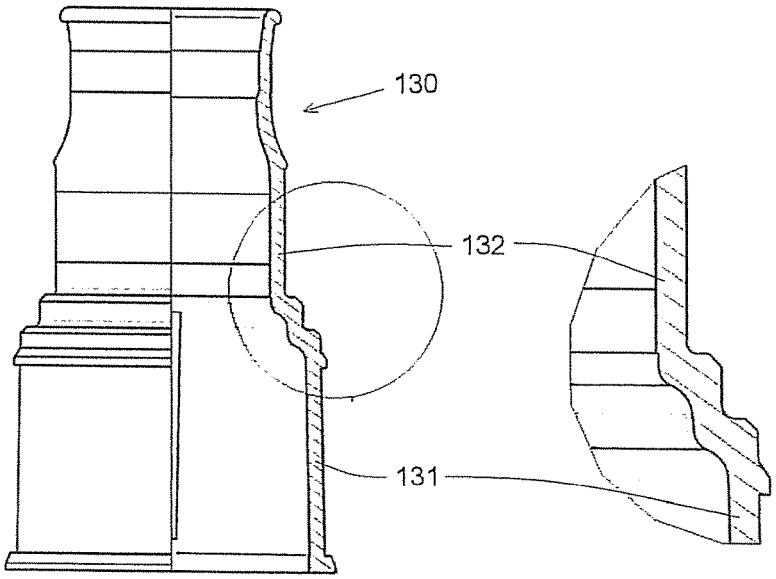
Fig 9b
Fig 9c

COLLAPSIBLE POUCH PROVIDED WITH A CLOSURE ASSEMBLY

The present invention relates to a collapsible pouch provided with a pre-assembled closure assembly and to a pre-assembled closure assembly to be sealed between two film walls of a collapsible pouch.

The present invention also relates to a method of manufacturing a collapsible pouch provided with a pre-assembled closure assembly.

The present invention also relates to a method of sterilization in a retort process of a product filled collapsible pouch provided with a pre-assembled closure assembly.

Figure 17:
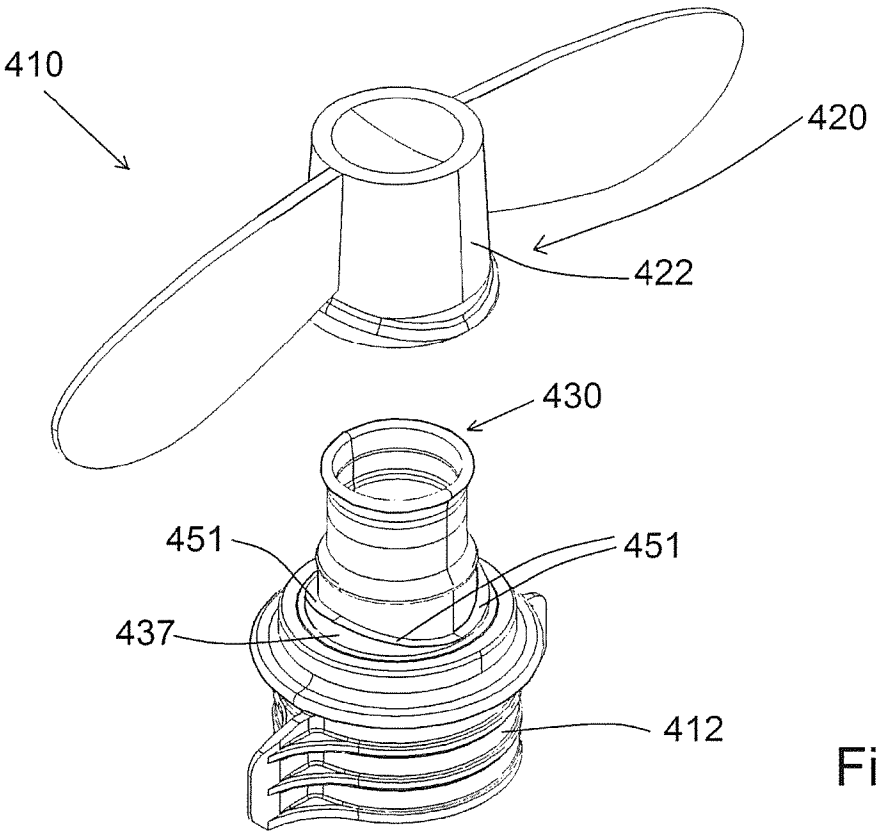

EP 763 482 B1—upon which the preamble of claim 1 is based—discloses, e.g. with reference to FIG. 17 thereof, a collapsible pouch having a product chamber between two walls of film material including at least an inner layer of plastic. A closure assembly is sealed between the two walls of the collapsible pouch. This known closure assembly comprises a monolithic spout base and cap part, which is injection molded of plastic material. Herein the spout base and cap part comprises a spout base delimiting a bore which extends through the spout base. The bore has a lower opening at one end thereof and an opposed cap side opening. The spout base has a sealing wall having an exterior surface to which the two walls of the collapsible pouch are sealed with their inner layer of plastic. The spout base and cap part further comprises a cap which comprises a top wall and a downward depending skirt forming an interior side of the cap and delimiting a cap cavity which is aligned with the bore of the spout body. The skirt has a lower edge remote from the top wall. The cap is provided on the exterior side thereof with a circular rib forming a sealing face.

The cap is at the lower edge of the skirt integral with the spout base via an integrally molded frangible zone that connects the cap to the spout base such that the cap is manually removable and upon motion of the cap in an opening direction by the user for the first time the frangible zone breaks.

The present invention aims to provide an improved collapsible pouch with closure assembly, or at least to provide an alternative for known collapsible pouches with closure assemblies.

The present invention provides a collapsible pouch provided with a closure assembly according to the preamble of claim 1, which is characterized in that the closure assembly is a pre-assembled closure assembly and in addition to the monolithic spout base and cap part comprises a tubular inner part, preferably injection molded of plastic material, wherein the inner part comprises a fixation portion and a neck portion, which inner part has been inserted into the spout base and cap part via the lower opening of the bore thereof in a pre-assembly operation prior to sealing of the pre-assembled closure assembly between said two walls of the collapsible pouch, wherein the fixation portion is received and fixed in the bore of the spout base and wherein the neck portion protrudes from the spout base into the cap cavity and extends to a mouth of the neck portion, and in that the neck portion is provided with at least one circumferential sealing surface, and in that the cap has at the interior side thereof at least one circumferential sealing surface that sealingly engages said at least one circumferential sealing surface of the neck portion.

In embodiments the pre-assembled closure assembly allows to guarantee that when the cap is removed a clean neck portion appears, which is e.g. advantageous if it is envisaged that the consumer will drink directly from the pouch by placing the neck portion between the lips.

After removal of the cap any remnants of the broken frangible zone do not affect the outflow of product from the pouch. Also, e.g. when the consumer will drink directly from the pouch by placing the neck portion between the lips, any remnants will not be unpleasing to the consumer as in embodiments the design may place them remote from the place where the consumers lips will touch the neck portion.

In embodiments the pre-assembled closure assembly allows for improved and/or alternative sealing arrangements of the cap in view of replacement of the cap onto the neck portion after the first time opening compared to the mentioned prior art. For example, as will be explained also with reference to embodiments, multiple seals can be obtained between the cap and the neck portion at distinct locations.

In embodiments the pre-assembled closure assembly allows for the provision of ramps, screw thread, and the like that may aid the consumer in the removal of the cap as such means may cause the cap to be lifted whilst the consumer rotates the cap in order to remove the cap.

In embodiments the neck portion is circular in cross-section at its mouth end and is oval in cross-section in a region directly above the spout base. The cap then has a corresponding design, so that the frangible zone is an oval. This oval shape of the frangible zone is deemed favorable for the effort needed to cause the breaking of the frangible zone.

In embodiments the pre-assembled closure assembly allows for the use of different materials, e.g. plastics, for the spout base and cap part on the one hand and the inner part on the other hand.

For example the different materials have a different hardness.

For example the spout base and cap part plastic material is tailored for sealing to the inner layer of the pouch walls, e.g. of similar plastic material, and the inner part is tailored in view of mouth feel for the consumer.

For example the inner part has a different color than the spout base and cap part.

For example the spout base and cap part plastic material is polypropylene. This is e.g. advantageous when the product filled pouch is subjected to a retort processing at elevated temperatures. In an alternative the spout base and cap part is made of polyethylene.

For example the inner part is made of polypropylene. This is e.g. advantageous when the pouch is subjected to a retort processing at elevated temperatures. In an alternative the inner part is made of polyethylene.

In an embodiment the cap further includes an integrally molded annular inner sealing ring depending downward from the top wall, concentric with respect to the skirt of the cap, with the inner sealing ring having an inner face, an outer face, and a lower edge. The outer face of the inner sealing ring includes a first circumferential sealing surface that is—in the pre-assembled state—in sealing contact with a corresponding first circumferential sealing surface of the interior side of the neck portion and provides a first seal between the cap and the neck portion. This provides for an effective seal of the cap upon reclosing the pouch with the cap. Also it allows to sterilize the pre-assembled closure assembly after its manufacturing internally, e.g. using hydrogen peroxide, without the (liquid) sterilant entering between the cap and the neck portion as the first seal then forms a barrier.

It is noted that first seal, second seal, and third seal mentioned herein do not necessarily imply a total number of seals. Instead "first", "second", and "third" when discussing the seals are used in this application merely to distinguish between the mentioned seals. The pre-assembled closure assembly may comprise any of the mentioned seals, or multiple thereof.

In an embodiment the interior side of the neck portion is provided with an inward tapering annular guide surface that extends from said mouth opening downward and that is contacted by an inner sealing ring of the cap in the process of insertion of the inner part into bore and into the cap cavity of the spout base and cap part, and then causes an elastic deformation of the inner sealing ring and/or of the neck portion.

In an embodiment the exterior side of the neck portion at or near the mouth opening thereof forms a second circumferential sealing surface that is in sealing contact with a corresponding second circumferential sealing surface on the interior side of the cap to provide a second seal between the cap and the neck portion. For example this embodiment is combined with the first seal mentioned above, so that a double seal is obtained between the cap and the mouth end of the neck portion.

In an embodiment the interior side of the skirt of the cap—at or near the lower end of the skirt—is provided with a third circumferential sealing surface that is in sealing contact with a corresponding third circumferential sealing surface on the exterior side of the neck portion to provide a third seal between the cap and the neck portion, preferably said sealing surfaces being oriented to provide a radial sealing between the skirt of the cap and the neck portion. This seal is advantageous if the frangible zone is not embodied as a continuous, non-apertured circumferential body portion of the spout base and cap. The third seal then prevents any ingress of matter, e.g. sterilant, between the cap and the interior side of the skirt via openings in the frangible zone, e.g. between web portions forming the frangible zone with openings between adjacent web portions.

As is preferred the frangible zone is a continuous, non-apertured circumferential body portion of the spout base and cap part. As explained this may obviate the desirability of a third seal as above.

In an embodiment the fixation portion of the inner part, preferably at or near the lower end thereof that faces away from the neck portion, is provided with a circumferential sealing surface that is in sealing contact with a corresponding sealing surface on the interior side of the bore in the spout base to provide a seal between the inner part and the fixation portion of the spout base. This design avoids any ingress of matter, e.g. product, between the inner part and the spout base from the interior of the pouch.

In an embodiment the spout base and the fixation portion are provided with cooperating abutment faces that define the position of the inner part relative to the spout base and cap part in the direction of insertion of the inner part. This e.g. allows to simply press the inner part into the spout base until the abutment faces meet and inhibit further insertion.

In an embodiment the spout base and the fixation portion are provided with cooperating anti-rotation faces that prohibit rotation of the inner part relative to the spout base and cap part. This e.g. is advantageous in view of any possible sealing between the inner part and the spout base and/or in view of the provision of any ramps or the like on the inner part that cooperate with the cap so as to lift the cap in the opening process. It is then preferred that the inner part is not rotatable relative to the spout base part.

In an embodiment the fixation portion is provided with a series of teeth around its exterior and the spout base is provided with a series of corresponding recesses on its interior such that a tooth is received in a corresponding recess. These meshing teeth and recesses provide cooperating anti-rotation faces, e.g. absorbing torque when the cap is rotated to break the frangible zone.

In an embodiment that allows for easy securing of the cap upon reclosing of the pouch the interior side of the skirt and the exterior side of the neck portion are provided with cooperating snap-fit formations that allow to snap-fit the cap on the neck portion, preferably said snap-fit formations being engaged upon insertion of the inner part into the spout base and cap part. For example a circumferential snap-fit rib is present on the exterior of the neck portion and the interior of the skirt of the cap is provided with a mating circumferential snap-fit rib or a series of snap-fit protrusions.

In a practical embodiment the bore of the spout base is circular, e.g. formed by a cylindrical sealing wall extending around the circular bore. In another embodiment, which prevents or aids to prevent rotation of the inner part relative to the spout base, the bore is non-circular, e.g. oval, hexagonal, etc. Preferably the fixation portion of the inner part has a correspondingly shaped exterior, e.g. an oval exterior shape to fit in an oval bore.

In a practical embodiment the sealing wall, e.g. a cylindrical sealing wall, is provided with two diametrically opposed fins thereon which extend in a common plane, the fins being sealed between the opposed film walls of the pouch as is known in the art.

In a practical embodiment the sealing wall has on its exterior multiple parallel ribs above one another as is known in the art.

In an embodiment the inner part is provided with an outward shoulder portion that extends underneath the lower edge of the skirt. This outward shoulder portion and the lower end of the skirt are provided with cooperating ramp faces that are inclined relative to a plane normal to the insertion direction of the inner part, such that upon rotation of the cap the cooperating ramp faces cause a lifting of the cap relative to the spout base. This lifting action may be used to enhance the breaking of the frangible zone and may assists the release of cooperating snap-fit formations between the cap and the neck portion when present.

In an embodiment the spout body is provided with a radially protruding flange above the sealing wall, e.g. so as to extend over the top rim of the walls of the pouch. The flange may be used for handling the pouch. If desired multiple flanges can be provided.

In an embodiment the spout body and cap part is injection molded from polypropylene and the inner layer of the film walls is of polypropylene. This is advantageous if sterilization by means of a retort process is envisaged of a product filled pouch. Polypropylene offers desirable characteristics for such applications.

In an embodiment the film walls include—in addition to the plastic inner layer—one or more layers chosen from: aluminum, polyamide, polyester.

In an embodiment the closure assembly and the pouch are resistant to a retort process wherein a product filled pouch is subjected to a temperature of between 115 and 125 Celsius for at least one minute, e.g. between one and 15 minutes.

In an embodiment the neck portion and the interior of the skirt are each provided with integrally molded and cooperating rotational connection means, preferably first and second screw threads on said neck portion and skirt respectively.

The present invention also relates to the pre-assembled closure assembly as disclosed herein, adapted to be sealed between opposed film walls of a collapsible pouch.

The present invention also relates to a method for manufacturing a collapsible pouch with a pouch closure assembly, e.g. of a product filled pouch with such a closure assembly. This method comprising the steps of:

providing a collapsible pouch comprising two film walls, said two film walls forming an opening between the two film walls, preferably between peripheral edge zones of the two film walls, providing a pre-assembled closure assembly that is to be sealed in the opening between said two walls of the collapsible pouch, said providing comprising the steps of:

injection molding a spout base and cap part according to one or more of the preceding claims, providing, e.g. injection molding, an inner part according to one or more of the preceding claims, inserting the inner part into the spout base and cap part according to one or more of the preceding claims, so as to assemble the sealing the pre-assembled closure assembly in the opening between said two walls of the collapsible pouch.

In an embodiment the method further includes the step of filling the pouch with a product, e.g. a liquid, powdery or pasty product.

Preferably the pouch is provided in a state with a single opening at the top, wherein prior to arranging of the pre-assembled closure assembly in this opening the pouch is filled with a product, e.g. a food product, wherein after the step of filling the pouch, the closure assembly is arranged in the opening and the sealing of the closure assembly therein is performed in one or more sealing steps.

In an embodiment the method further includes the step of sterilization of the product filled pouch in a retort process, wherein the product filled pouch is subjected to a temperature of between 115 and 125 Celsius for at least one minute, e.g. between one and 15 minutes, preferably at an elevated pressure, in an autoclave.

The present invention is advantageous for relatively small closure assemblies, e.g. with a diameter of the product passage between 4 and 15 millimeters.

The invention does not require additional tamper-evident elements on the spout base and the cap to bring about a tamper-evident function, as the breaking of the frangible zone already provides this function.

For example if an apertured frangible zone is envisaged the one or more apertures could be established not during the injection moulding process thereof, but by an additional manufacturing step. For example one or more holes or slits, or other weakenings, e.g. grooves, could be made in the moulded part to create or enhance the frangible zone. This additional manufacturing step could even be performed after the inner part has been inserted into the spout base and cap part, or even after the closure assembly has been sealed between the opposed film walls, e.g. using a cutting device, e.g. a laser cutting device, or a punching device, or other suitable tool, e.g. arranged at a dedicated station in a FFS (Form Fill Seal) installation.

The assembly can be embodied to cause breakage of the frangible zone on the basis of a very limited rotation of the cap from its closed position, e.g. at most half a turn, so that the user experiences a rather immediate breakage when he/she starts to open the closure.

Figure 1:
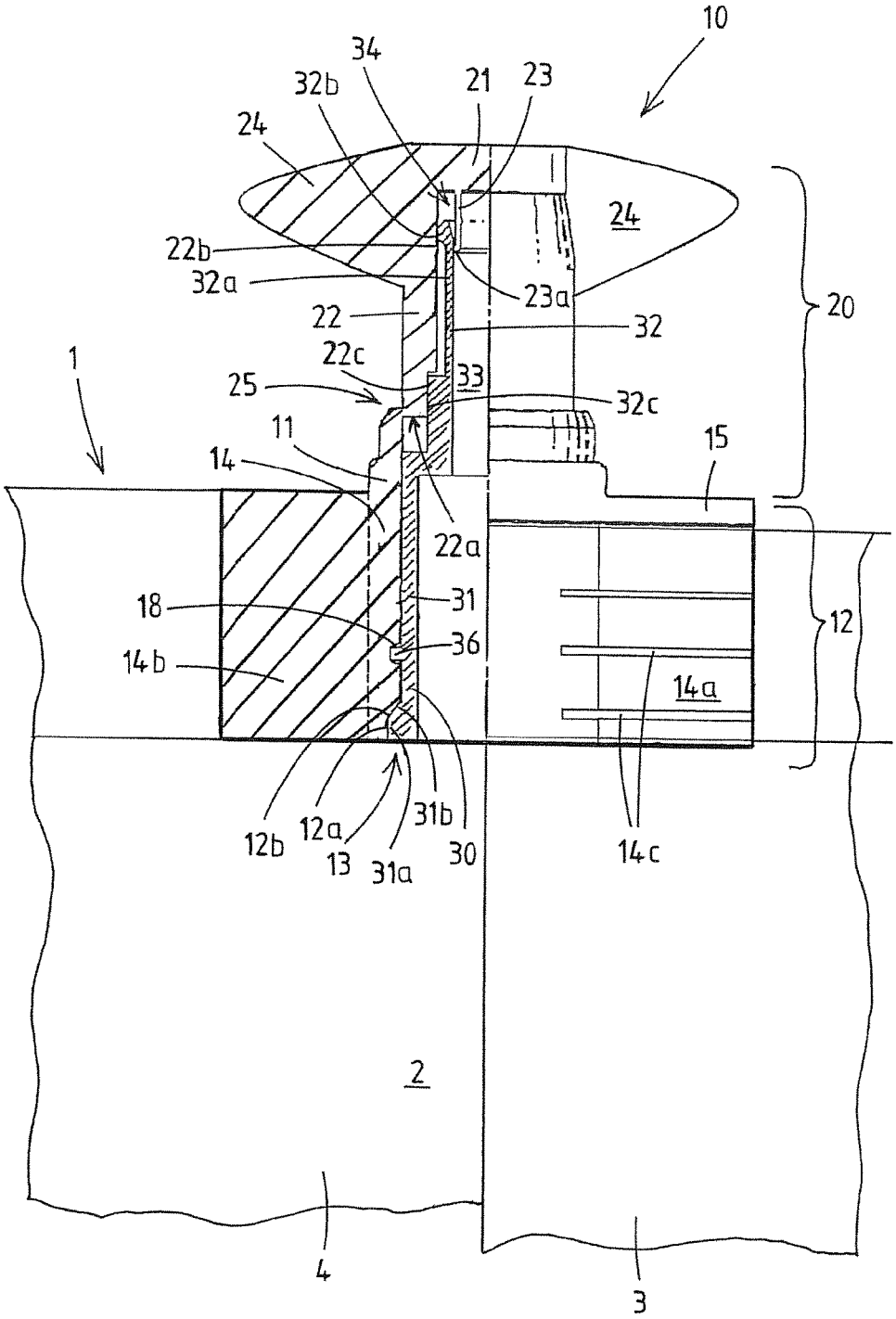
Figure 2A:
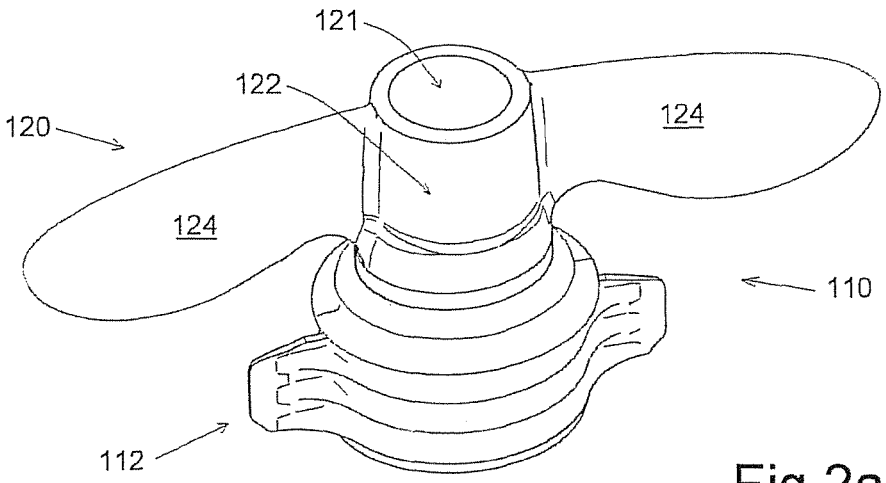
Figure 2B:
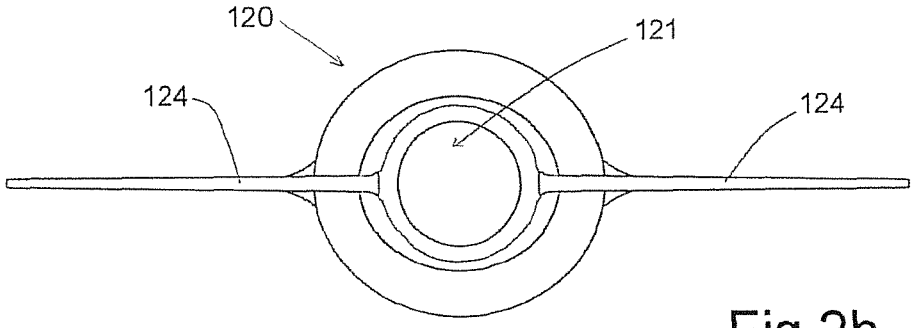
Figure 3A:
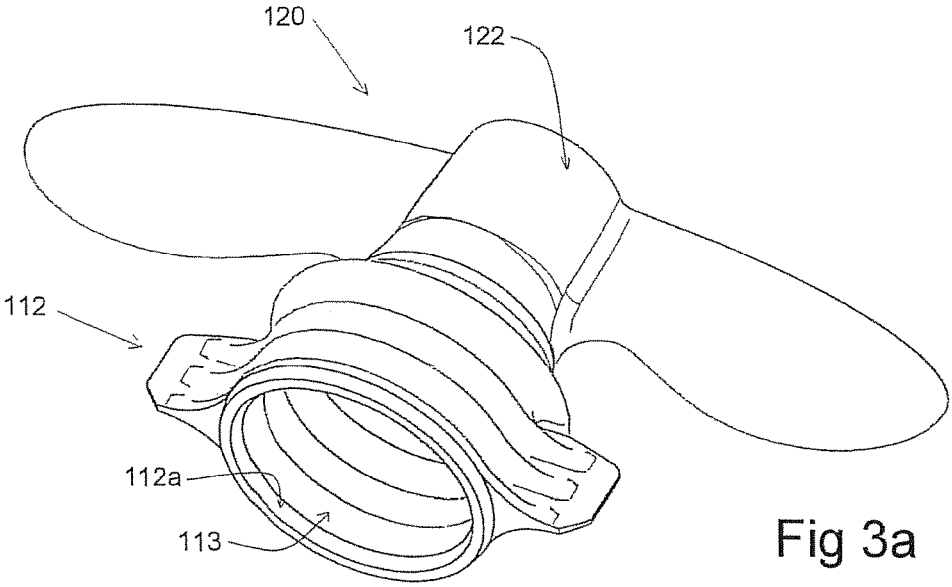
Figure 3B:
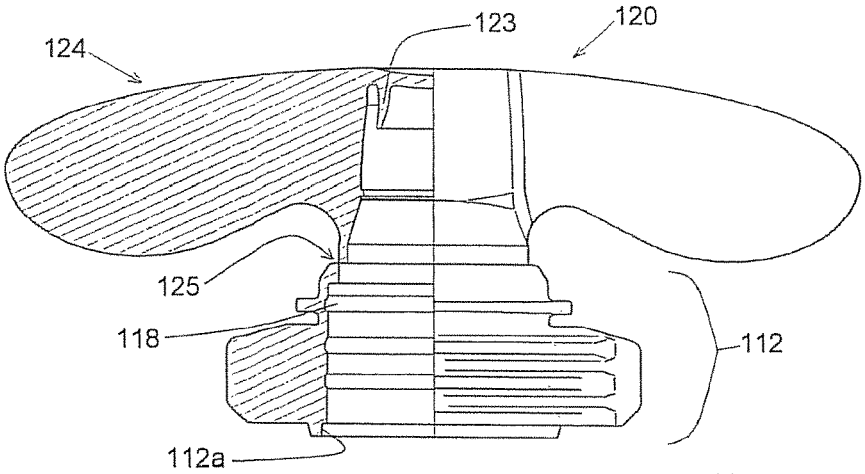
Figure 3C:
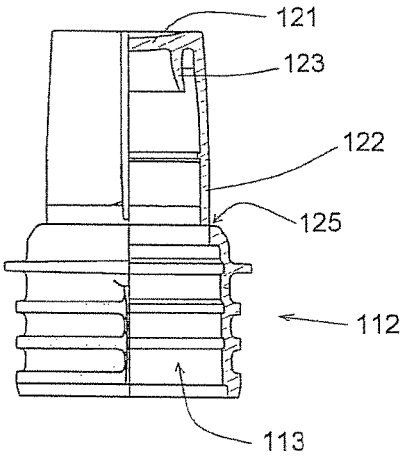
Figure 4:
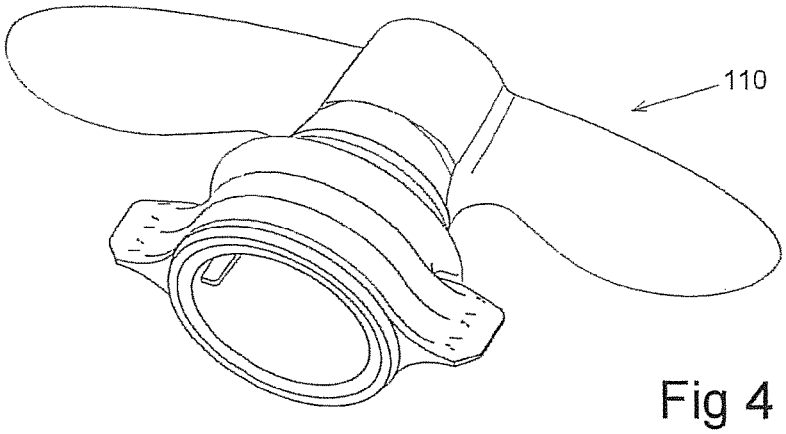
Figure 5:
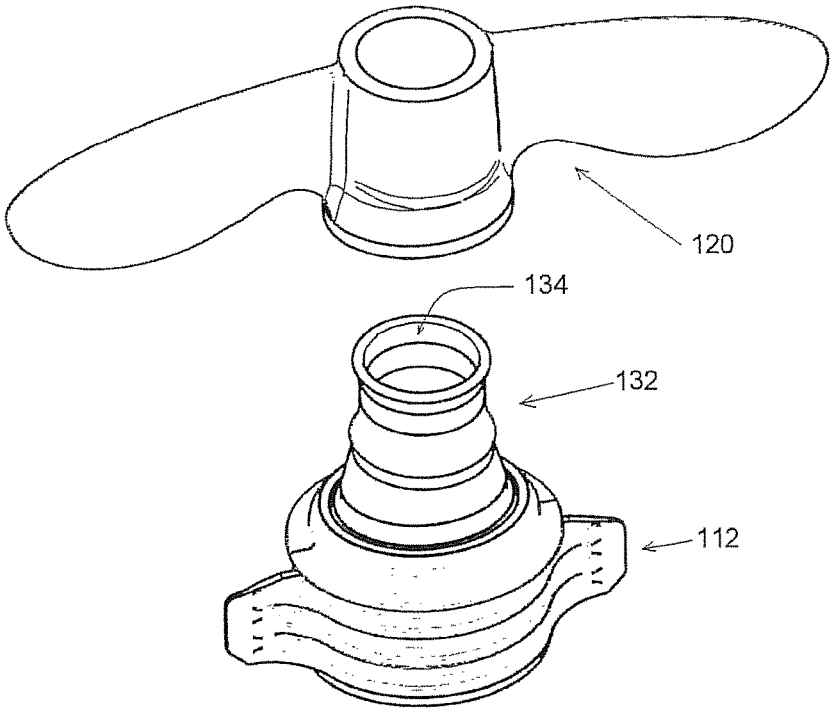
Figure 6A:
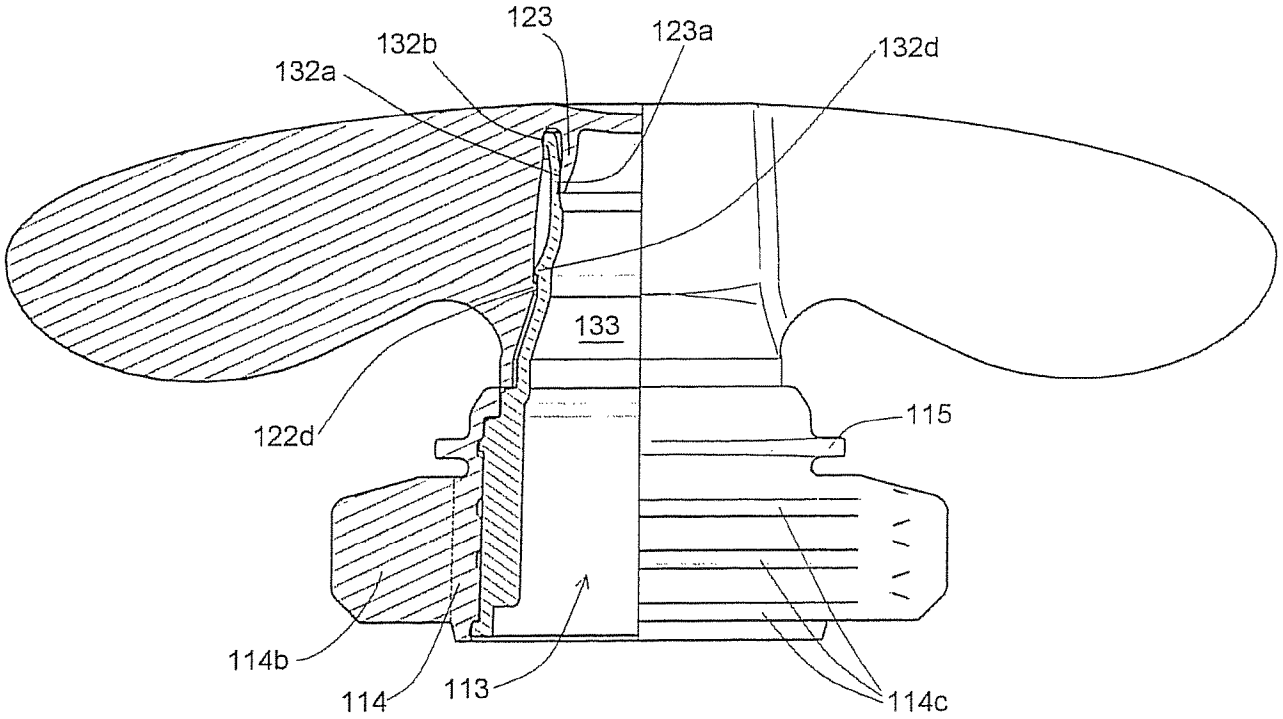
Figure 6B:
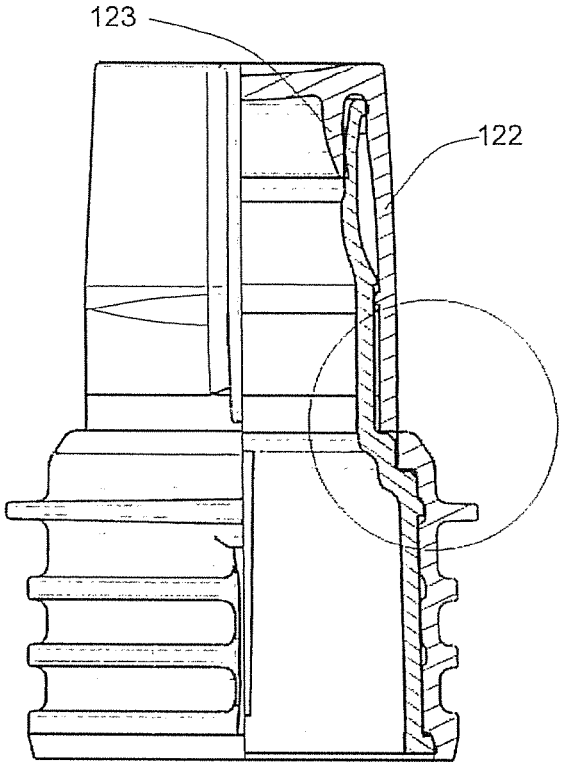
Figure 6C:
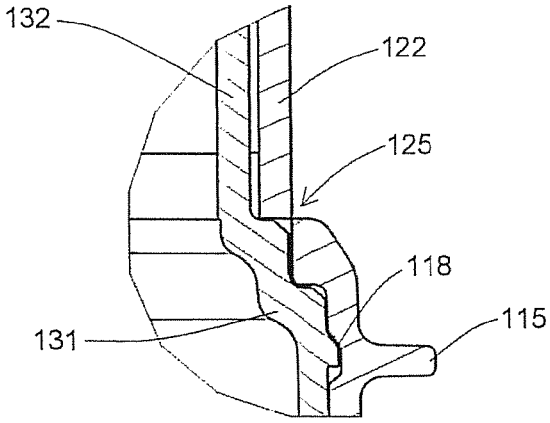
Figure 7:
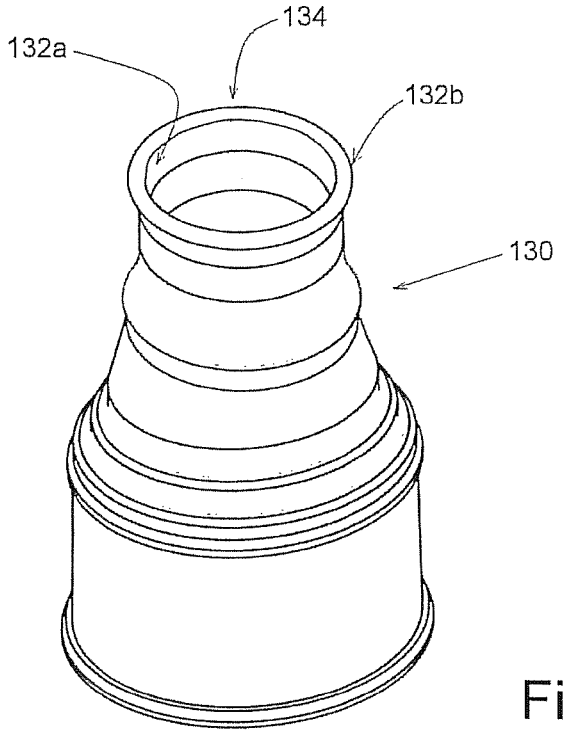
Figure 8:
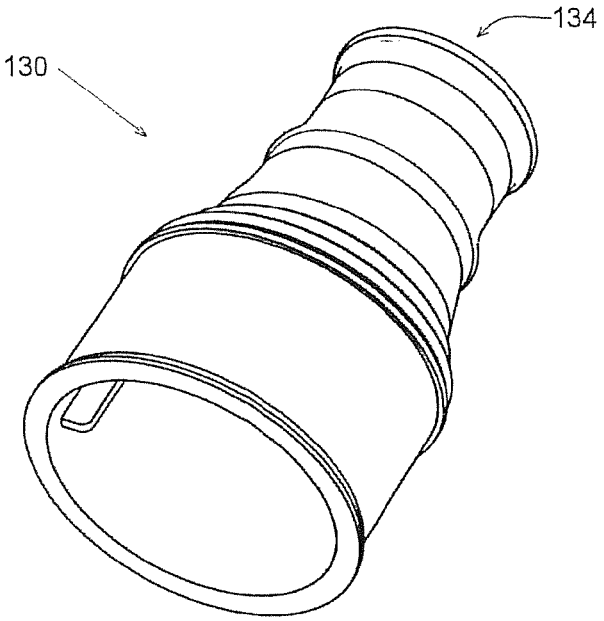
Figure 10:
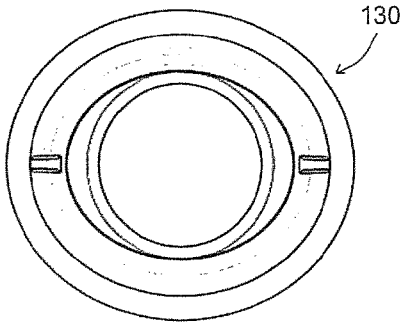
Figure 11:
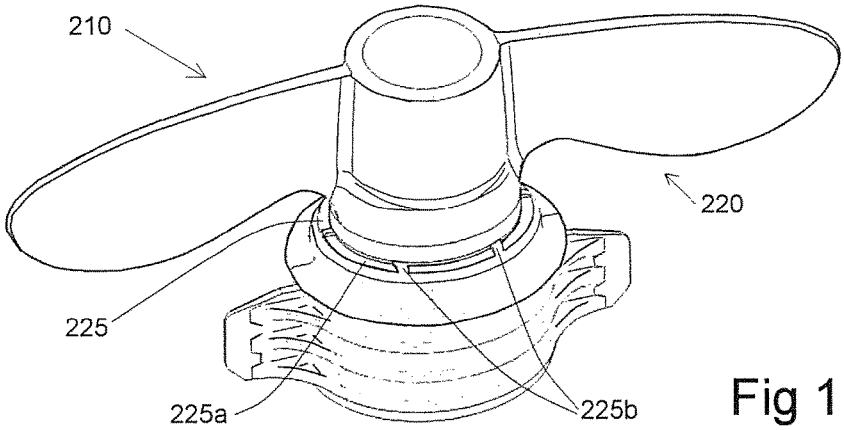
Figure 12:
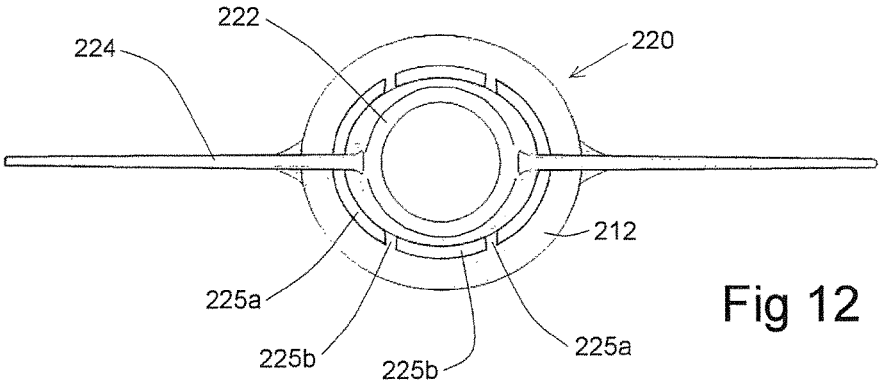
Figure 13A:
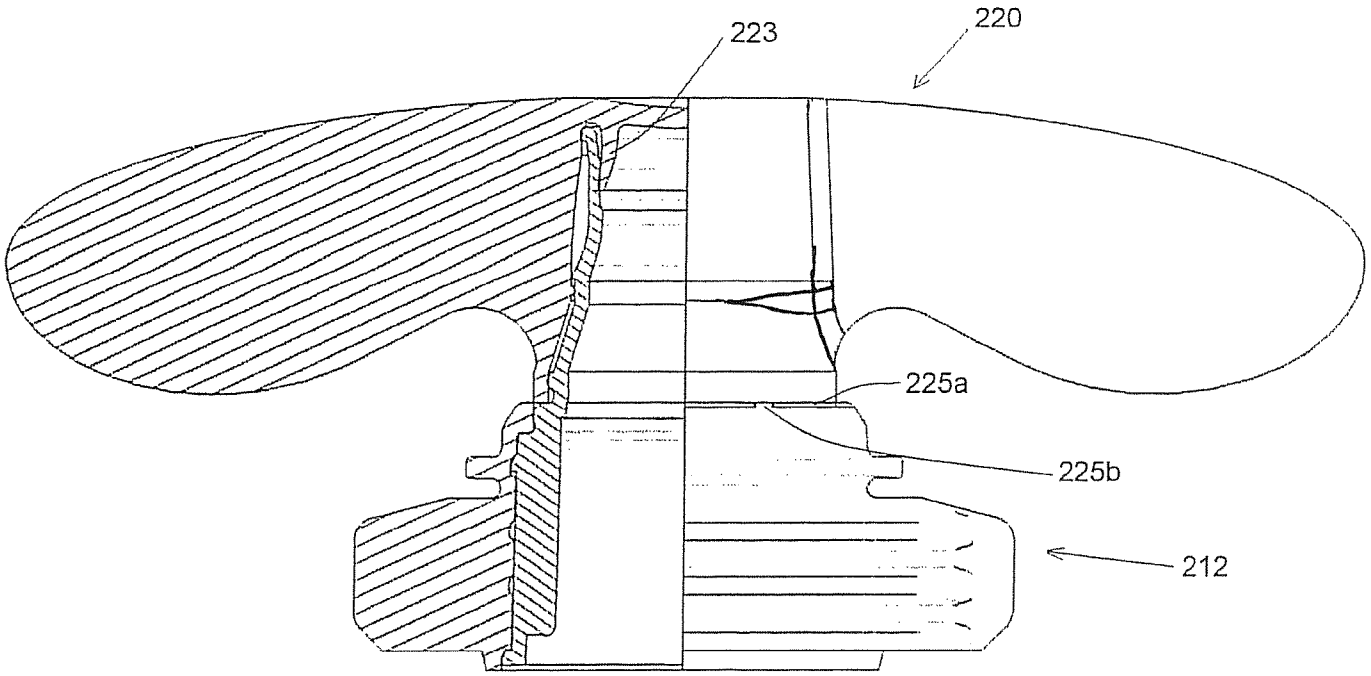
Figure 13B:
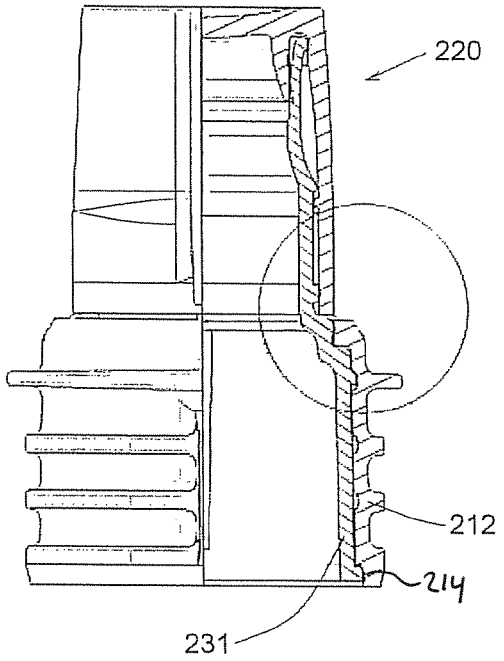
Figure 13C:
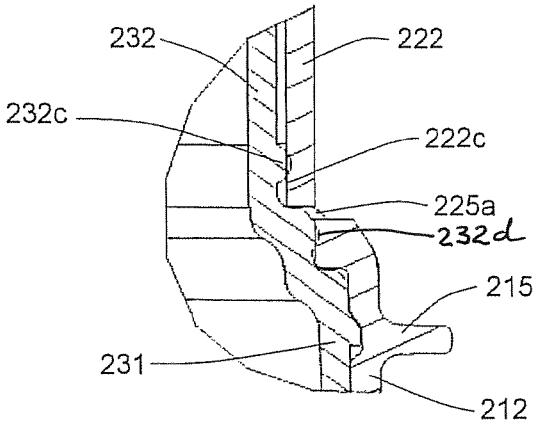
Figure 14:
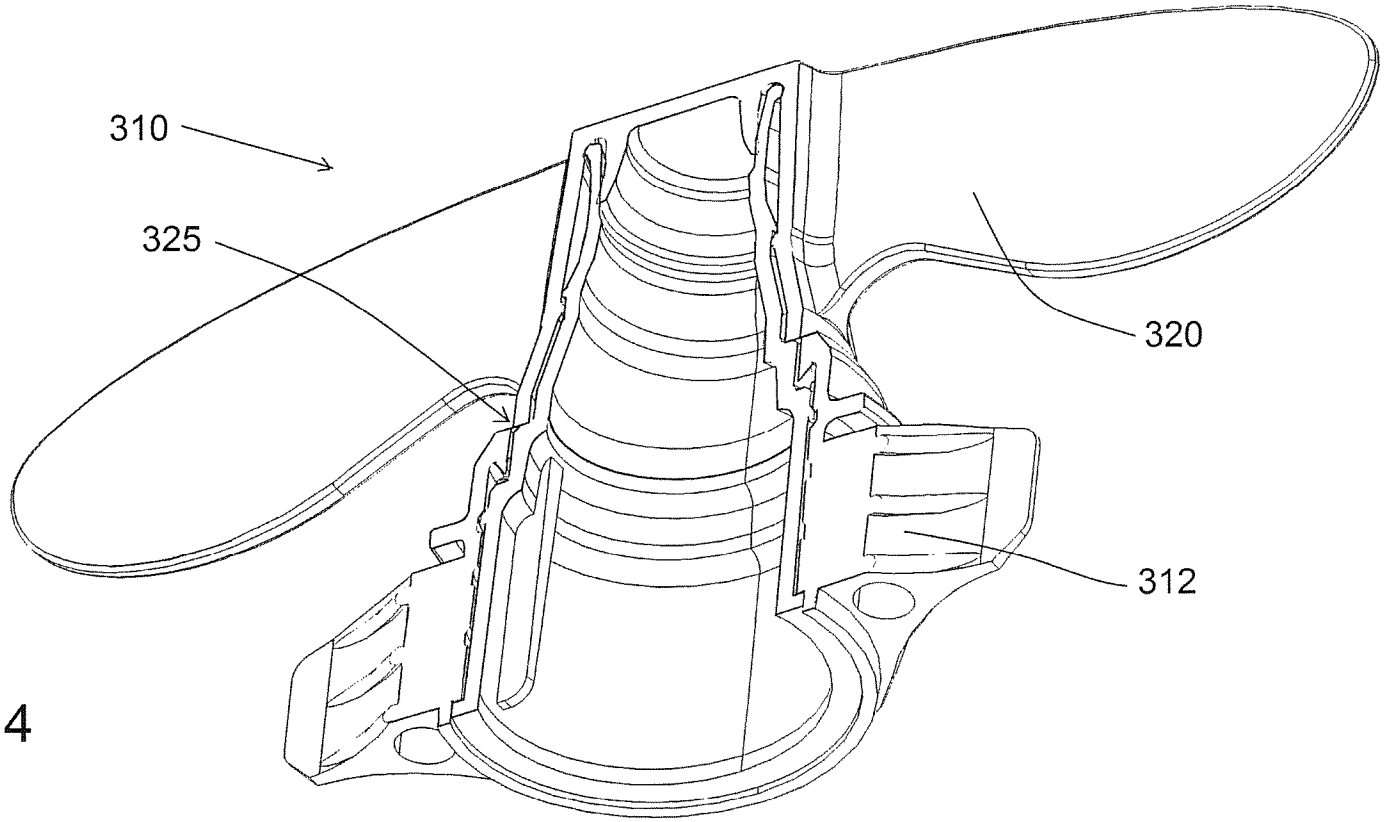
Figure 15:
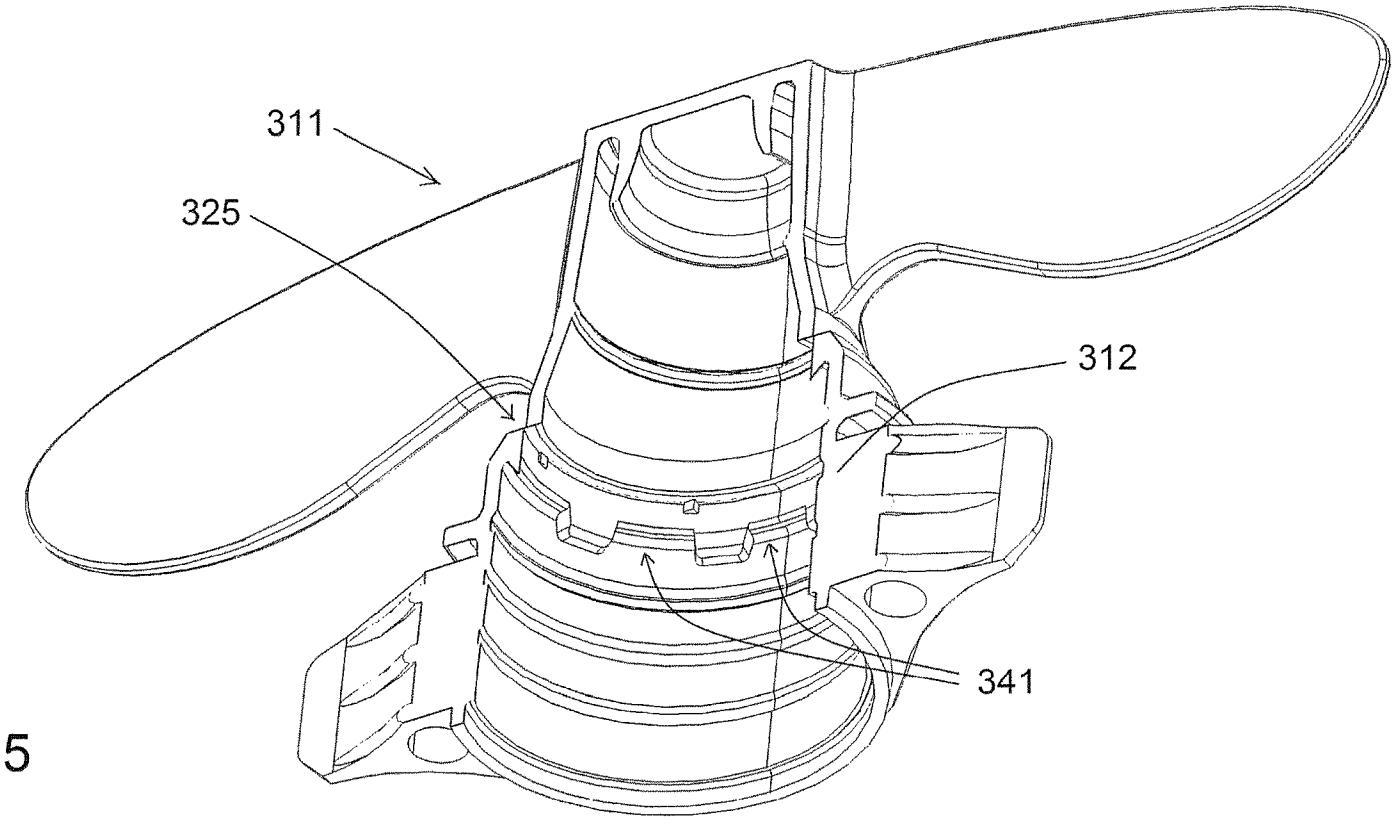
Figure 16:
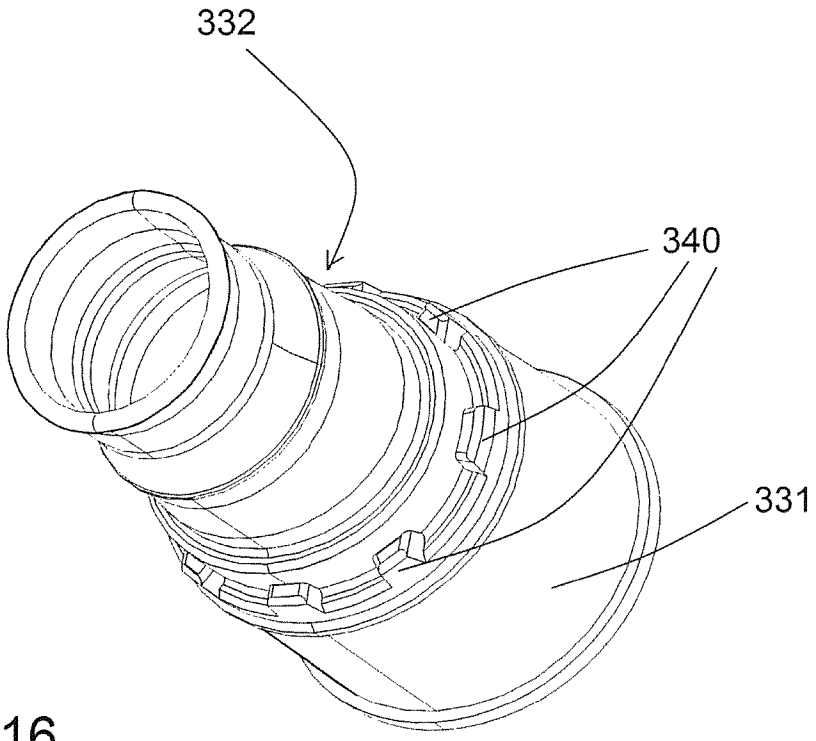
Figure 18:
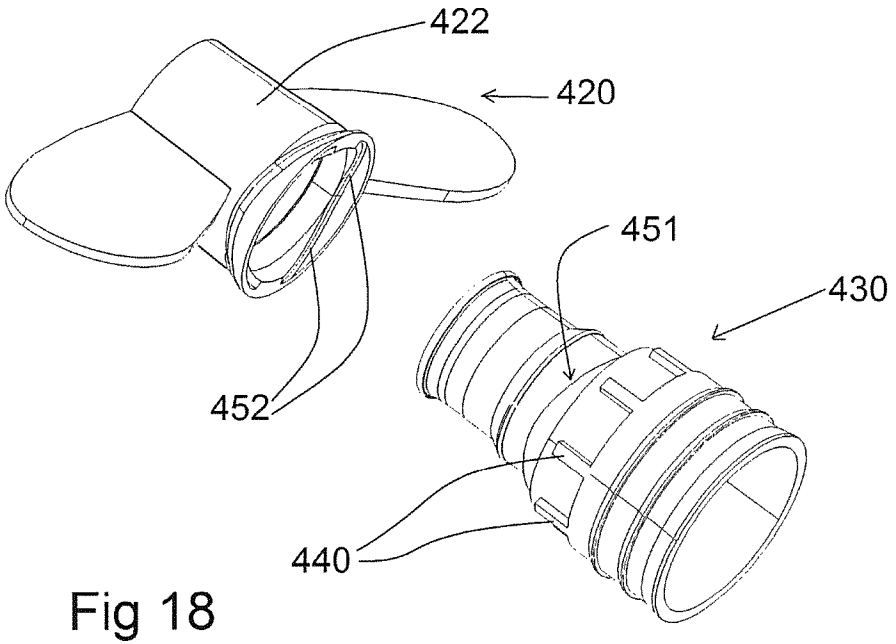

The invention will now be explained in more detail with reference to the drawings. In the drawings:

FIG. 1 shows in side view, partly in cross-section a collapsible pouch provided with a pre-assembled closure assembly, FIG. 2*a* shows a preferred embodiment of a pre-assembled closure assembly in perspective view from above, FIG. 2*b* shows the embodiment of FIG. 2*a* from above, FIG. 3*a* shows the monolithic spout base and cap part of the assembly of FIG. 2*a* in perspective view from below, prior to insertion of the inner part of the assembly, FIGS. 3*b, c* shows the monolithic spout base and cap part of the assembly of FIG. 2*a* in part cross-sections, FIG. 4 shows the pre-assembly of FIG. 1 in perspective view from below, with the inserted inner part, FIG. 5 illustrates the removal of the cap to expose the neck portion, e.g. to be placed between the lips of a consumer drinking from a pouch to which the assembly is sealed, FIGS. 6*a-c* shows the assembly of FIG. 2 in part cross-sections, before removal of the cap, and a detail thereof on enlarged scale, FIG. 7 shows the inner part of the assembly of FIG. 2*a* in perspective view from above, FIG. 8 shows the inner part of FIG. 7 in perspective view from below, FIGS. 9*a, b* show the inner part of FIG. 7 in part cross-sections, FIG. 10 shows the inner part of FIG. 7 from below, FIG. 11 shows a second preferred embodiment of a pre-assembled closure assembly in perspective view from above, FIG. 12 shows the embodiment of FIG. 11 from above, FIGS. 13*a-c* show the assembly of FIG. 11 in part cross-sections, before removal of the cap, and a detail thereof on enlarged scale, FIG. 14 shows a third preferred embodiment of a pre-assembled closure assembly in cross-section, FIG. 15 shows the spout base and cap part of the assembly of FIG. 14, FIG. 16 shows the inner part of the assembly of FIG. 14, FIG. 17 shows a fourth preferred embodiment of a pre-assembled closure assembly in opened state, FIG. 18 shows the cap and the inner part of the closure assembly of FIG. 17.

With reference to FIG. 1 now a first embodiment of the invention will be discussed. As will be apparent for the skilled person, many features discussed with reference to the FIG. 1 embodiment equally apply, or may apply, to the embodiment shown in FIGS. 2-10, and the embodiments shown in FIGS. 11-13, 14-16, 17, 18.

FIG. 1 shows a portion of a collapsible pouch 1 having a product chamber 2 between two walls 3, 4 of film material including at least one inner layer of plastic. In this example the inner layer can be of polypropylene, e.g. combined with one or more additional layers in the film material as a laminated film material. For example the laminated film includes one or more layers chosen from: aluminum, polyamide, polyester.

Whilst not shown for reasons of clarity, it is understood that the pouch 1 has already being filled with a product, e.g. a food product.

After filling the product into the pouch 1 a pre-assembled closure assembly 10 has been sealed between the peripheral edge regions of the two opposed walls 3, 4 of the collapsible pouch 1.

The closure assembly 10 comprises a monolithic spout base and cap part 11, which is injection molded as a single unitary part of plastic material, e.g. of polypropylene.

This spout base and cap part 11 comprising a spout base 12 delimiting a bore 13 which extends through the spout base. This bore 13 has a lower opening at one end thereof and an opposed cap side opening (here shown at the top end of the base 12). The bore 13 of the spout base is circular, but may have another e.g. oval, hexagonal, or other form in cross-section, e.g. a form as so to act as anti-rotation fitting for inner part 30.

The spout base 12 has a sealing wall 14 that has an exterior surface to which the two walls 3, 4 of the collapsible pouch 1 are sealed with their inner layer of plastic. It is shown here, by way of example, that the sealing wall 14 is a cylindrical wall, provided with two diametrically opposed fins 14*a, b* thereon which extend in a common plane. Also the sealing wall 14 here includes horizontal ribs 14*c* as part of the exterior of the sealing wall 14.

The spout base 12 is provided with an integrally molded and radially protruding flange 15 above the sealing wall 14.

The spout base and cap part 11 further comprises a cap 20, here a rotational cap to be opened by a rotational opening motion of the consumer. In an alternative the cap can be designed to be pulled from the neck portion upon first time opening, but a rotational opening motion is preferred.

The cap 20 has a top wall 21 and a downward depending skirt 22 forming an interior side of the cap and delimiting a cap cavity which is aligned with the bore 13 of the spout body 12.

The skirt 22 has a lower edge 22*a* remote from the top wall 21.

The cap 20 has protruding finger grip portions, here embodied as diametrically opposed wings 24, that facilitate exerting a torque by hand on the cap 20 in order to break the cap 20 from the spout base 12.

At the lower edge of the skirt 22 the cap 20 is integral with the spout base 12 via an integrally molded frangible zone 25 connecting the cap 20 to the spout base 12 such that the cap is manually removable and upon motion of the cap in an opening direction by the user for the first time the frangible zone 25 breaks. As is preferred this frangible zone 25 is integrally molded as a continuous, non-apertured circumferential body portion of the spout base and cap part 11.

In addition to the monolithic spout base and cap part 11 the pre-assembled closure assembly comprises a tubular inner part 30, also injection molded of plastic material, as is preferred as a monolithic part 30.

This tubular inner part 30 comprises a fixation portion 31 and a neck portion 32. A product passage 33 forms the hollow interior of the tubular part. As is preferred the passage 33 is open at the lower end thereof and at a mouth opening 34 of the neck portion. In alternative embodiment a membrane or the like may extend across the passage 33, e.g. a pierceable or removable membrane. Possibly the membrane is integrally molded with the inner part 30, or for example, an aluminum foil membrane has been fitted over the mouth end 34 to be later removed by the consumer after first having removed the cap 20.

In an embodiment the inner part 30 has a lower extension portion, preferably integrally molded, that extends below the spout body 12 when assembled and extends into the chamber of the pouch. For example this lower extension is embodied to avoid collapsing of the pouch directly in front of the opening of the passage 33.

The inner part 30 has been inserted into the spout base and cap part 11 via the lower opening of the bore 13 thereof in a pre-assembly operation prior to sealing of the pre-assembled closure assembly between the two walls 3, 4 of the collapsible pouch 1.

The fixation portion 31 is received and fixed in the bore 13 of the spout base 12. The neck portion 32 protrudes from the spout base 12 into the cap cavity of the cap 20 and extends to the mouth opening 34 of the neck portion.

As can be seen the cap, in this example, further includes an integrally molded annular inner sealing ring 23 depending downward from the top wall 21, concentric with respect to the skirt 22. This inner sealing ring 23 has an inner face, an outer face, and a lower edge.

It is illustrated that the outer face of the inner sealing ring 23 includes a first circumferential sealing surface 23*a*, near the edge, that is—in pre-assembled state—in sealing contact with a corresponding first circumferential sealing surface 32*a* of the interior side of the neck portion 32 to provide a first seal between the cap 20 and the neck portion 32.

It is illustrated that the interior side of the neck portion is provided with an inward tapering annular guide surface that extends from the mouth opening 34 downward and that is contacted by the inner sealing ring 23 of the cap 20 in the process of insertion of the inner part 30 into bore 13 and the cap cavity of the spout base and cap part 11, and then causes an elastic deformation of the inner sealing ring 23 and/or of the neck portion 32.

It is illustrated that the exterior side of the neck portion 32, here near the mouth opening 34 thereof, forms a second circumferential sealing surface 32*b* that is in sealing contact with a corresponding second circumferential sealing surface 22*b* on the interior side of the cap 20, here of the skirt 22, to provide a second seal between the cap 20 and the neck portion 32 in the pre-assembled state.

It is illustrate that the interior side of the skirt 22 of the cap 20, here near the lower end of the skirt, is provided with a third circumferential sealing surface 22*c* that is in sealing contact with a corresponding third circumferential sealing surface 32*c* on the exterior side of the neck portion 32 to provide a third seal between the cap 20 and the neck portion 32. These sealing surfaces are here shown as oriented to provide a radial sealing between the skirt 22 of the cap 20 and the neck portion 32.

It is illustrated that the fixation portion 31 of the inner part 30, here at the lower end thereof that faces away from the neck portion 32, is provided with a circumferential sealing surface 31*a* that is in sealing contact with a corresponding sealing surface 12*a* on the interior side of the bore 13 in the spout base 12 to provide a seal between the inner part and the fixation portion of the spout base.

The FIG. 1 illustrates that the spout base 12 and the fixation portion 31 are provided with cooperating abutment faces 12*b*, 31*b* that define the position of the inner part 30 relative to the spout base and cap part 11 in the direction of insertion of the inner part.

In this example it is illustrated that the inner part 30 is snap-fitted into the spout base 12 by means of one or more bosses or protrusions 36 on the exterior of the inner part 30 engaging into corresponding one or more recesses 18 of the spout base 12. These cooperating formations may also be designed to form cooperating anti-rotation faces that prohibit rotation of the inner part 30 relative to the spout base and cap part 12.

The manufacturing of the collapsible pouch 1 with a pouch closure assembly 10 is done by providing the collapsible pouch 1 with the two film walls 3, 4 in a state wherein the two film walls 3, 4 form an opening between the two film walls, here between peripheral edge zones of the two film walls 3, 4.

Also the pre-assembled closure assembly 10 that is to be sealed in the opening between the two walls 3, 4 of the collapsible pouch is provided by:

injection molding a spout base and cap part 11, injection molding the inner part 30, inserting the inner part 30 into the spout base and cap part 11 so as to assemble the assembly 10.

The opening between the two film walls, preferably is the only opening of the pouch to be filled with the product. Then it is envisaged that the product, e.g. a liquid, powdery or pasty product, is filled into the pouch via this opening, prior to arranging the assembly 10 onto the pouch so as to hermetically close the pouch 1.

The pre-assembled closure assembly 10 is then placed in the opening between the two walls of the collapsible pouch 1 and sealed, e.g. by heat-sealing with heated jaws or ultrasonic or otherwise, between the film walls 3,4.

For some products, e.g. food products, it is envisaged that the method further includes the step of sterilization of the filled pouch 1 in a retort process, wherein the pouch 1 is subjected to a temperature of between 115 and 125 Celsius for at least one minute, e.g. between one and 15 minutes, preferably at an elevated pressure, in an autoclave, e.g. using steam. The assembly 10 is not penetrated by the sterilizing steam or other sterilizing agent.

With reference to FIGS. 2-10 now a first preferred embodiment of a pre-assembled closure assembly according to the invention will be discussed. Herein the same or similar elements are denoted with same reference numerals as used in FIG. 1 starting from 100. The skilled person will have no problem ascertaining all corresponding features from the figures. As far as features have already been explained no further discussion will be presented here and reference is made to the above.

As discussed the sealing between the cap 120 and the neck portion 132 may involve one or more of the mentioned first, second, and third seal. In this example the third seal, at or near the lower edge of the skirt, is absent. This is acceptable as the zone 125 is non-apertured so that any ingress of matter from the outside is prevented as long as the cap 120 is integral with the spout base 112.

The cap 120, as is preferred, does have the first and second seals at the neck portion, as has been discussed above.

A further feature of the assembly 110 is that interior side of the skirt 122 and the exterior side of the neck portion 132 are provided with cooperating snap-fit formations 122*d*, 132*d* (see e.g. FIG. 6*a*) that allow to snap-fit the cap 20 on the neck portion. These snap-fit formations 122*d*, 132*d* are already engaged upon insertion of the inner part 130 into the spout base and cap part 112.

Another feature of the assembly 110 is that the inner part 130 is provided with an outward shoulder portion 137 that extends underneath the lower edge 122*c* of the skirt 122.

This outward shoulder portion 137 and the lower edge 122*c* of the skirt may be provided with cooperating ramp faces respectively that are inclined relative to a plane normal to the insertion direction of the inner part, here normal to the central axis of tubular inner part 130, such that upon rotation of the cap by the consumer the cooperating ramp faces cause a lifting of the cap relative to the spout base, assisting the release of cooperating snap-fit formations as well as promoting the breaking of zone 125.

In an embodiment, as an alternative to a snap-fit of the cap 20, 120 one can envisage that the neck portion and the interior of the skirt are each provided with integrally molded and cooperating rotational connection means, preferably with first and second screw threads on said neck portion and skirt respectively. It is then advantageous for the inner part to be rotated during insertion thereof into the spout body and cap part, so as to engage the threads, e.g. until a snap-fit between the fixation portion and the spout base is reached.

The inner part 30, 130 could also be secured in the spout base by means of heat-sealing, application of adhesive, elastic hook members, a press fit, or otherwise.

In the embodiment of FIGS. 2-10 the bore 113 of the spout base is oval in cross-section and the fixation portion 131 is shaped to fit in the oval bore, so that rotation of the inner part relative to the spout base and cap part is prohibited.

In the embodiment of FIGS. 2-10 the frangible zone 125 is a continuous, non-apertured circumferential body portion of the spout base and cap part. As long as the cap 120 has not been removed, no ingress of matter along this zone 125 is possible.

In order to facilitate the breaking of the zone 125 it is illustrated that in the region of the inner part 130 that is present just above the spout base 112, the cross-section of the neck portion 132 and of the mating part of the cap 120 is oval. This enhances the breaking of the zone 125 when the cap 120 is twisted by the user to open the collapsible pouch.

It is also shown that a transition section of the neck portion, adjacent said zone 125, has a shape that varies from an oval contour at the zone 125 to a circular contour at the other axial end of the transition section. The cap has a correspondingly shaped section on its interior so that upon opening of the cap by rotation these sections interact and provide a lifting force on the cap enhancing the breaking of the zone and removal of the cap.

With reference to FIGS. 11-13 now a second preferred embodiment of a pre-assembled closure assembly 210 according to the invention will be discussed. Herein the same or similar elements are denoted with same reference numerals as used in FIG. 1 starting from 200. As far as features have already been explained no further discussion will be presented here and reference is made to the above.

The FIGS. 11, 12 and 13 clearly illustrate that the frangible zone 225 is embodied as an apertured frangible zone, with apertures 225*a* between frangible webs 225*b*. The provision of webs and apertures may be used to dimension the effort required for opening of the closure and/or to provide enhanced visibility of the first breaking of the webs 225*b*.

As an apertured frangible zone 225 does allow for the ingress of matter, it is shown that the cap 220 has at its lower end of the skirt 222 a sealing surface 222*c* which sealingly engages on a sealing surface 232*c* on the neck portion 234 of the inner part. Thereby any ingress between the cap 220 and the neck portion 234 is effectively blocked.

In general it can be envisaged that in combination with one or more of the mentioned first, second, and third seals between the cap and the neck portion of the inner part, there may possibly also be one or more seals between the spout base and the fixation portion of the inner part.

For example, e.g. when an aperture frangible zone 225 is provided for, it is envisaged that an upper spout base and inner part seal may be established, near the frangible zone 225, between the inner part 231 of the closure assembly and the spout base 212. This is indicated in FIG. 13*c* as the contact between sealing surface 232*d*, e.g. circumferential rib, on the inner part 231 on the one hand and the spout base 212 on the other hand.

For example, e.g. if the closure assembly is to be sterilized prior to mounted in a collapsible pouch, it is envisaged that a lower spout base and inner part seal may be established, in the lowermost region of overlap between the inner part and the spout base, in order to avoid ingress of sterilizing agent in the seam. This is indicated in FIG. 13*b* at 214.

The one or more seals between the fixation portion of the inner part and the spout body can be achieved by this fixation portion and spout base having mating sealing surfaces that press onto one another when the inner part is mounted in the spout base and cap part. A seal can also be formed by other means such as the provision of a sealing ring, filling a seam with a sealant or an adhesive, or e.g. with targeted welding, e.g. laser welding to form the lower spout base and inner part seal which may also serve to connect the inner part to the spout base.

With reference to FIGS. 14-16 now a third preferred embodiment of a pre-assembled closure assembly 310 according to the invention will be discussed. Herein the same or similar elements are denoted with same reference numerals as used in FIG. 1 starting from 300. As far as features have already been explained no further discussion will be presented here and reference is made to the above.

The FIGS. 14-16 illustrate that the fixation portion 331 of the inner part 330 is provided with a series of teeth 340 around its exterior and that the spout base 312 is provided with a series of corresponding recesses 341 on its interior such that each tooth 340 is received in a corresponding recess 341 as the inner part 330 is axially introduced into the bore of the spout base 312. These meshing teeth 340 and recesses 341 provide cooperating anti-rotation faces, e.g. absorbing torque when the cap is rotated to break the frangible zone 325.

As can be seen the inner part 330 is oval and received in an corresponding oval bore of the spout base. If wall thicknesses of the inner part and/or spout base are limited this form-fit does not provide sufficient anti-rotation effect and therefore the meshing teeth 340 and recesses 341 are beneficial. Similar teeth 440 are visible in FIG. 18.

As shown here, the teeth 340 may be provided as raised teeth 340 protruding from a shoulder of the fixation portion.

With reference to FIGS. 17, 18 a fourth preferred embodiment of a pre-assembled closure assembly 410 according to the invention will be discussed. Herein the same or similar elements are denoted with same reference numerals as used in FIG. 1 starting from 400.

As far as features have already been explained no further discussion will be presented here and reference is made to the above.

The inner part 430 is provided with an outward shoulder portion 437 that extends underneath the lower edge of the skirt 422.

This outward shoulder portion 437 and the lower edge of the skirt 420 are provided with cooperating ramp faces 451, 452 respectively that are inclined relative to a plane normal to the insertion direction of the inner part, here normal to the central axis of tubular inner part 430, such that upon rotation of the cap 420 by the consumer the cooperating ramp faces cause a lifting of the cap 420 relative to the spout base 412 promoting the breaking of zone 425.

In this example the ramp faces 451, 452 are embodied to act in either direction of rotation so that it does not matter in which direction the user rotates the cap upon first time opening of the assembly 410.

It will be appreciated by the skilled person that the described collapsible pouch may be subjected to a retort process, e.g. in an autoclave, or other sterilization process. As preferred the frangible zone is then non-apertured, but as explained the same treatments can also be combined with an apertured frangible zone, e.g. when one or more seals are present between the fixation portion of the inner part and the spout base to avoid any ingress of sterilizing agent between the inner part and the spout base when the entire product filled pouch is sterilized. As is the preferred the cap is then provided with the mentioned third seal to the neck portion. Due to elevated retort processing the material of choice for the closure assembly is Polypropylene.

In a simpler process the pouch is not subjected to any retort process. Then embodiments wherein just the mentioned first seal and/or the second seal is/are present may properly meet all requirements if the non-apertured frangible zone is applied. If the apertured frangible zone is applied additional seals will be required as explained herein, e.g. the seal between the fixation portion and the spout base close to the frangible zone. The material of the closure assembly may be High Density Polyethylene.

For aseptic filling processing, wherein the closure assembly is to be treated with sterilizing agent prior to assembly in the pouch, one may provide at least for the first seal, preferably also for the second seal, and in case of an apertured frangible zone also the third seal.

Additionally one or more seals should be provided to avoid ingress of sterilizing agent between the spout base and the inner part. As these sterilizing processes usually do not involve elevated temperatures but e.g. use peroxide as sterilizing agent, the material can e.g. be High Density Polyethylene.

The invention claimed is:

1. A collapsible pouch (1) provided with a closure assembly (10; 110; 210; 310; 410), comprising:

said collapsible pouch (1) having a product chamber (2) between two walls (3,4) of film material, said closure assembly (10; 110; 210; 310; 410) that is sealed between said two walls of the collapsible pouch, wherein the closure assembly comprises:

a monolithic spout base and cap part (11; 111; 311), which is cast as a single piece, molded of plastic material, said monolithic spout base and cap part comprising a spout base (12; 112; 212; 312; 412) delimiting a bore (13; 113) which extends through the spout base, said bore having a lower opening at one end thereof and an opposed cap side opening, wherein the spout base has a sealing wall having an exterior surface to which said two walls of the collapsible pouch are sealed, said monolithic spout base and cap part further comprising a cap (20; 120; 220;320; 420), wherein the cap comprises a top wall (21; 121) and a downward depending skirt (22; 122; 222) forming an interior side of the cap and delimiting a cap cavity which is aligned with the bore of the spout base, said skirt having a lower edge remote from the top wall, wherein the cap (20; 120; 220) is integral with the spout base (12; 122) via an integrally molded frangible zone (25; 125; 225; 325; 425) connecting the cap to the spout base such that the cap is manually removable and upon motion of the cap in an opening direction by the user for the first time the frangible zone breaks, wherein the closure assembly is a pre-assembled closure assembly (10; 110; 210; 310; 410) and in addition to the monolithic spout base and cap part (11; 111) comprises a tubular inner part (30; 130; 230; 330; 430), wherein the tubular inner part (30; 130; 230; 330; 430) comprises a fixation portion (31; 131; 231) and a neck portion (32; 132; 232), wherein the tubular inner part is structurally configured to be insertable into the monolithic spout base and cap part (11; 111) through the lower opening of the bore thereof, wherein the fixation portion (31; 131; 331; 431) is received and fixed in the bore of the spout base (12;112; 212) and wherein the neck portion (32;132) protrudes from the spout base into the cap cavity and extends to a mouth opening (34;134) of the neck portion, and in that the neck portion (32; 132) is provided with at least one circumferential sealing surface (32*a*, 32*b*, 32*c*; 132*a*, 132*b*), and in that the cap has at the interior side thereof at least one circumferential sealing surface (23*a*, 22*b*, 22*c*; 123*a*) that sealingly engages said at least one circumferential sealing surface of the neck portion.

2. The collapsible pouch provided with the closure assembly according to claim 1, wherein the cap (20; 120; 220; 320) further includes an integrally molded annular inner sealing ring (23; 123) depending downward from said top wall, concentric with respect to the skirt (22; 122; 222), the annular inner sealing ring having an inner face, an outer face, and a lower edge, wherein the outer face of the annular inner sealing ring (23; 123) includes a first circumferential sealing surface (23*a*; 123*a*) that is in sealing contact with a corresponding first circumferential sealing surface (132*a*) of the interior side of the neck portion (32;132) to provide a first seal between the cap and the neck portion.

3. The collapsible pouch provided with the closure assembly according to claim 1, wherein the exterior side of the neck portion (32; 132) at or near the mouth opening (34; 134) thereof forms a second circumferential sealing surface (32*b*; 132*b*) that is in sealing contact with a corresponding second circumferential sealing surface (22*b*) on the interior side of the cap (20) to provide a second seal between the cap and the neck portion.

4. The collapsible pouch provided with the closure assembly according to claim 1, wherein the interior side of the skirt (22) of the cap —at or near the lower end of the skirt—is provided with a third circumferential sealing surface (22*c*) that is in sealing contact with a corresponding third circumferential sealing surface (32*c*) on the exterior side of the neck portion (32) to provide a third seal between the cap and the neck portion.

5. The collapsible pouch provided with the closure assembly according to claim 1, wherein the fixation portion (31;131) of the inner part is provided with a circumferential sealing surface (31*a*) that is in sealing contact with a corresponding sealing surface (12*a*) on the interior side of the bore (13) in the spout base to provide a seal between the tubular inner part (30;130) and the fixation portion (12;112) of the spout base.

6. The collapsible pouch provided with the closure assembly according to claim 2, wherein the interior side of the neck portion (32;132) is provided with an inward tapering annular guide surface that extends from said mouth opening (34;134) downward and that is contacted by the annular inner sealing ring (23; 123) of the cap (20; 120; 220) in the process of insertion of the tubular inner part into bore and the cap cavity of the monolithic spout base and cap part, and then causes an elastic deformation of the annular inner sealing ring (23; 123) and/or the neck portion (32;132).

7. The collapsible pouch provided with the closure assembly according to claim 1, wherein the spout base (12; 112; 212) and the fixation portion (31;131) are provided with cooperating abutment faces (12*b*,31*b*) that define the position of the tubular inner part relative to the monolithic spout base and cap part in the direction of insertion of the tubular inner part.

8. The collapsible pouch provided with the closure assembly according to claim 1, wherein the spout base and the fixation portion are embodied to prohibit rotation of the tubular inner part relative to the monolithic spout base and cap part.

9. The collapsible pouch provided with the closure assembly according to claim 1, wherein the frangible zone (25; 125; 325, 425) is a continuous, non-apertured circumferential body portion of the monolithic spout base and cap part or wherein the frangible zone (225) is provided with one or more apertures (225*a*) therein.

10. The collapsible pouch provided with the closure assembly according to claim 1, wherein the interior side of the skirt and the exterior side of the neck portion are provided with cooperating snap-fit formations (122*d*, 132*d*) that allows the cap (120; 220; 320) to snap-fit on the neck portion (132).

11. The collapsible pouch provided with the closure assembly according to claim 1, wherein the bore (13; 113) of the spout base (12; 112; 212;312) is oval and wherein the fixation portion has a corresponding oval shape.

12. The collapsible pouch provided with the closure assembly according to claim 1, wherein sealing wall (14; 114) is provided with two diametrically opposed fins (14*a*, *b*; 114*a*, *b*) thereon which extend in a common plane.

13. The collapsible pouch provided with the closure assembly according to claim 1, wherein the tubular inner part (130) is provided with an outward shoulder portion (137) that extends underneath the lower edge of the skirt (122).

14. The collapsible pouch provided with the closure assembly according to claim 1, wherein the monolithic spout base and cap part (11;111) is injection molded from polypropylene and wherein an inner layer of the film walls (3,4) is of polypropylene.

15. A method for manufacturing the collapsible pouch (1) provided with the closure assembly (10; 110; 210) according to claim 1, said method comprising the steps of:

providing a collapsible pouch (1) comprising two film walls (3,4), said two film walls forming an opening between the two film walls, providing a pre-assembled closure assembly (10;110; 210; 310; 410) that is to be sealed in the opening between said two walls of the collapsible pouch, said providing comprising the steps of:

injection molding a monolithic spout base and cap part (11; 111), providing a tubular inner part (30; 130; 230; 330; 430), inserting the inner part into the monolithic spout base and cap part, so as to assemble the pre-assembled closure assembly, sealing the pre-assembled closure assembly (10; 110; 210; 310; 410) in the opening between said two film walls (3, 4) of the collapsible pouch.

16. The method according to claim 15, said method further including the step of filling the collapsible pouch (1) with a product.

17. The method according to claim 16, wherein said collapsible pouch (1) is provided in a state with a single opening at the top, and wherein prior to arranging of the pre-assembled closure assembly (10; 110; 210; 310; 410) in said opening the collapsible pouch is filled with the product, wherein after the step of filling the pouch, the pre-assembled closure assembly is arranged in the opening and the sealing of the pre-assembled closure assembly therein is performed in one or more sealing steps.

18. The method according to claim 16, wherein the method further includes the step of sterilization of the filled collapsible pouch (1) in a retort process, wherein the pouch is subjected to a temperature of between 115 and 125 degrees Celsius for at least one minute.

* * * * *